US010415182B2

(12) United States Patent
Piccirilli

(10) Patent No.: US 10,415,182 B2
(45) Date of Patent: Sep. 17, 2019

(54) SUBLIMATION PRINTING ON HIDE OR LEATHER

(71) Applicant: ENGLER ITALIA S.R.L., Casnate con Bernate (CO) (IT)

(72) Inventor: Bruno Piccirilli, Casnate con Bernate (IT)

(73) Assignee: ENGLER ITALIA S.R.L., Casnate con Bernate (CO) (IT)

( * ) Notice: Subject to any disclaimer, the term of this patent is extended or adjusted under 35 U.S.C. 154(b) by 0 days.

(21) Appl. No.: 15/736,990

(22) PCT Filed: Jun. 14, 2016

(86) PCT No.: PCT/IB2016/053495
§ 371 (c)(1),
(2) Date: Dec. 15, 2017

(87) PCT Pub. No.: WO2016/203366
PCT Pub. Date: Dec. 22, 2016

(65) Prior Publication Data

US 2018/0171548 A1 Jun. 21, 2018

(30) Foreign Application Priority Data

Jun. 16, 2015 (IT) ..... 102015000024229

(51) Int. Cl.

| | |
|---|---|
| ***D06P 5/28*** | (2006.01) |
| ***B41M 5/035*** | (2006.01) |
| ***D06P 3/32*** | (2006.01) |
| ***D06P 5/20*** | (2006.01) |
| ***D06P 5/30*** | (2006.01) |
| ***D06P 1/52*** | (2006.01) |
| ***B41J 3/407*** | (2006.01) |

(52) U.S. Cl.
CPC ..... *D06P 5/006* (2013.01); *B41J 3/4078* (2013.01); *B41M 5/035* (2013.01); *D06P 1/5221* (2013.01); *D06P 1/5271* (2013.01); *D06P 1/5278* (2013.01); *D06P 1/5285* (2013.01); *D06P 3/32* (2013.01); *D06P 5/004* (2013.01); *D06P 5/205* (2013.01); *D06P 5/2055* (2013.01); *D06P 5/2066* (2013.01); *D06P 5/2072* (2013.01); *D06P 5/30* (2013.01)

(58) Field of Classification Search
CPC ..... B41M 1/26; B41M 5/025; B41M 5/026; B41M 5/035; B41M 2205/02; D06P 1/5221; D06P 1/5271; D06P 1/5278; D06P 1/5285; D06P 3/32; D06P 5/004; D06P 5/006; D06P 5/30; D06P 5/205; D06P 5/2055; D06P 5/2072
USPC ..... 503/227; 8/436, 471; 428/32.1
See application file for complete search history.

(56) References Cited

U.S. PATENT DOCUMENTS

2004/0218028 A1 11/2004 Furukawa

FOREIGN PATENT DOCUMENTS

| | | |
|---|---|---|
| FR | 2534945 | 4/1984 |
| GB | 1584795 | 2/1981 |
| WO | WO02057090 | 7/2002 |

*Primary Examiner* — Gerard Higgins
(74) *Attorney, Agent, or Firm* — King & Schickli, PLLC

(57) ABSTRACT

A process of sublimation printing on hide or leather, a laminar substrate to be used in such a sublimation printing process, hide or leather treated to be printable, as well as hide or leather printed by said process of sublimation printing, are described.

12 Claims, 3 Drawing Sheets

SUBLIMATION PRINTING ON HIDE OR LEATHER

FIELD OF THE INVENTION

The present invention relates to a process of sublimation printing on hide or leather.

The present invention also relates to a laminar substrate to be used in said process of sublimation printing.

Also described are hide or leather treated to be printable by sublimation printing, as well as hide or leather printed by said process of sublimation printing.

STATE OF THE ART

Sublimation printing is a known printing process which has limited costs and which provides optimal results when carried out on synthetic material fabrics.

For such process, inks are used termed "sublimation inks" since they are made to sublimate during the printing process.

If such process is used on hide or leather, an unacceptable result is obtained since the pigments of commercial sublimation inks are not fixed well and stably on these natural substrates.

Therefore, said process is generally not used for printing on hide or leather.

In light of the advantages of sublimation printing, the object of the present invention is to find a way to use it on hide or leather as well.

SUMMARY OF THE INVENTION

Said object has been achieved by a process of sublimation printing on hide or leather, as set forth in claim 1.

For the purposes of the present invention, with "hide or leather" it is intended the material obtained from the hide of animals which, following a process termed 'tanning', is rendered imputrescible. Typically, hide or leather (in the current language, also the term 'skins' is used) is obtained from the hide of animals bred and slaughtered for food purposes, hence animals such as cattle, sheep, goats, pigs, horses, fish and, more rarely, kangaroos, deer, ostriches.

In another aspect, the present invention relates to a laminar substrate to be used in the process of sublimation printing.

In a further aspect, the present invention relates to hide or leather treated to be printable by sublimation printing.

In a still further aspect, the invention relates to a kit for sublimation printing on hide or leather, said kit comprising said laminar substrate, and at least one sublimation ink.

In a further aspect, the present invention relates to hide or leather printed by said process of sublimation printing.

BRIEF DESCRIPTION OF THE FIGURES

The characteristics and the advantages of the present invention will become apparent from the following detailed description, from the working examples provided for illustrative purposes, and from the annexed Figures wherein.

DETAILED DESCRIPTION OF THE INVENTION

Figure 1:
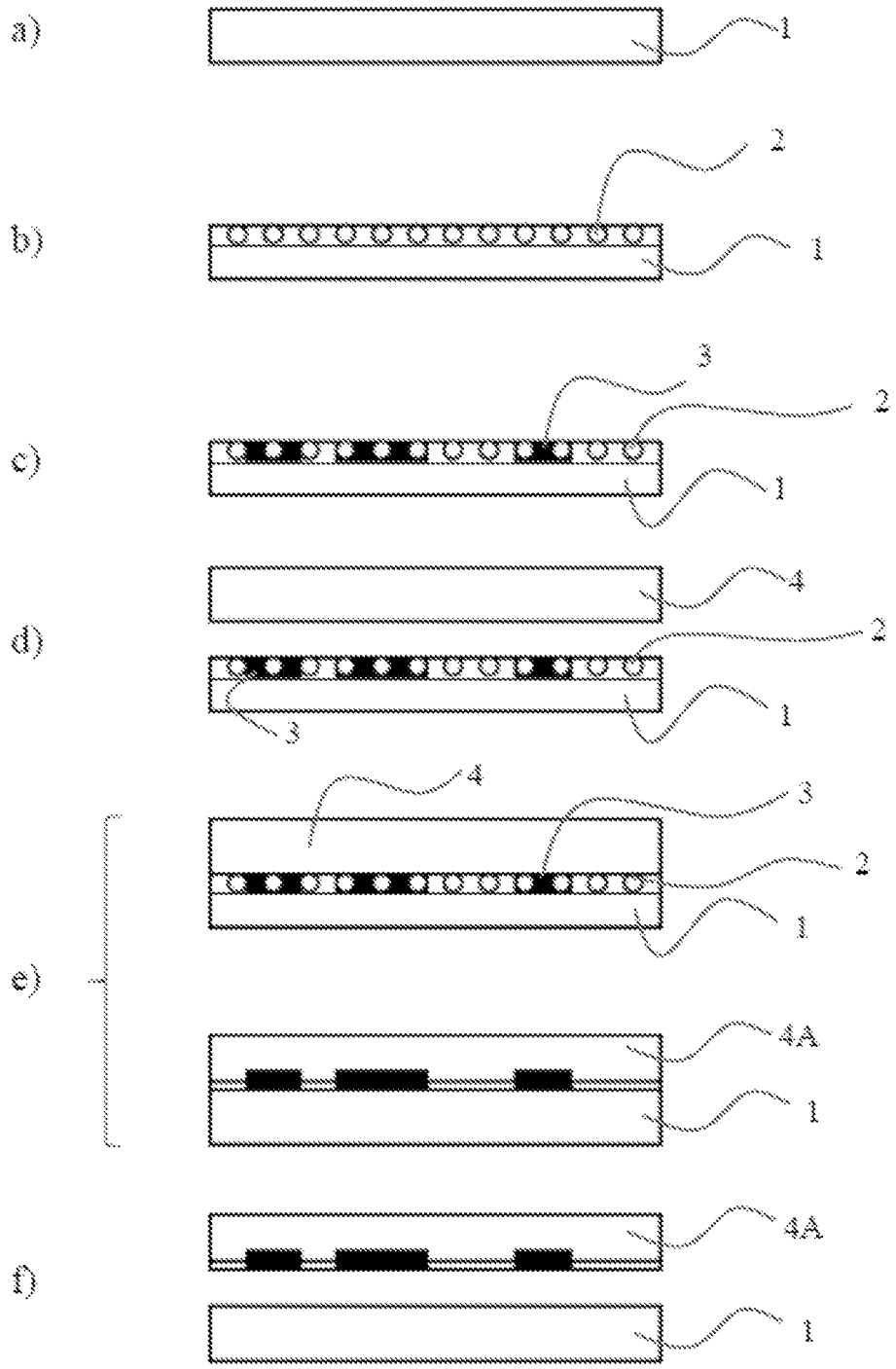
FIG. 1 shows a series of simplified sections, where the section lines are omitted, said simplified sections regarding the steps of Example 1.

The invention therefore relates to a process of sublimation printing on hide or leather, comprising the steps of:

a) providing a laminar substrate, b) applying a polymeric adhesive material comprising polyester, polyamide, polyurethane, polyethylene or a mixture thereof, on a side of said laminar substrate, d) providing hide or leather, e) hot pressing said side of the laminar substrate on said hide or leather, and f) separating the laminar substrate from hide or leather, wherein, between step b) and step d), a step c) of ink jet printing is carried out with a sublimation ink on said side of the laminar substrate, or alternatively after step f), a step g) of ink jet printing is carried out with a sublimation ink on hide or leather.

The process of the invention exploits the process of sublimation which allows transferring, by means of a hot press or a calender, the sublimation ink directly on hide or leather. During the heating, the ink, while coming into contact with the polymeric adhesive material, is combined substantially instantaneously with hide or leather in nearly permanent manner. The process allows obtaining hide or leather printed without any relief or thickness, washable and without altering the hide and leather texture. For the implementation of the process of the invention, the devices used for digital transfer printing are appropriate; such as a printer equipped with sublimation inks and a press or a calender for the hot transfer of size suitable for the product that one intends to print.

Step a) of the process of the invention provides that a laminar substrate is supplied. By 'laminar substrate', it is intended any substrate suitable for sublimation printing, hence suitable for being employed in a hot press or a calender.

Preferably, said laminar substrate is in the form of sheet or strip, and comprises paper, plastic material, or a combination thereof.

Suitable plastic materials are polyester, polyethylene terephthalate (PET), modified polyethylene terephthalate glycol (PETG) and polyethylene terephthalate film (PETF), and combinations thereof.

In preferred embodiments, said laminar substrate is paper.

Step b) provides for applying a polymeric adhesive material comprising polyester, polyamide, polyurethane, polyethylene or a mixture thereof, on one side of said laminar substrate.

Preferably, said polymeric adhesive material comprises LDPE, HDPE, copolyester, thermoplastic polyurethane, copolyamide or a mixture thereof.

The application of the polymeric adhesive material depends on the design of the final printing that it is desired to obtain; therefore, the polymeric adhesive material can be applied on the entire side of the laminar substrate or only to one or more parts thereof.

The polymeric adhesive material can be applied by known methods, such as spreading (e.g. flexographic or air blade), rotogravure or serigraphy.

The polymeric adhesive material is preferably applied on the side of the laminar substrate in an amount such as 10-50 $g/m^2$ (as measured once dried), more preferably 15-30 $g/m^2$. The term 'as measured once dried' means that the indicated amount is intended as measured at the end of step b) of application of the polymeric adhesive material, after the latter has been dried on the laminar substrate.

In preferred embodiments, the polymeric adhesive material is microencapsulated. In particular, this is microencapsulated in microcapsules each having an overall diameter of 40-100 μm. By "overall diameter", it is intended the average diameter of the microcapsules intended as core made of polymeric adhesive material and containment shell.

It has in fact been observed that microcapsules offer a greater degree of surface penetration of the polymeric adhesive material, thus significantly improving the quality and definition of the final printing.

In these preferred embodiments, step b) of application of said polymeric adhesive material on one side of said laminar substrate can be carried out by physical transport of the microencapsulated polymeric adhesive material, or electrical transport of the microencapsulated polymeric adhesive material, or by spreading of a resin containing the microencapsulated polymeric adhesive material, or by spraying a resin containing the microencapsulated polymeric adhesive material.

When a resin containing the microencapsulated polymeric adhesive material is used, this can comprise dispersants, non-ionic surfactants, Teflon waxes, or mixtures thereof.

The preparation of the microcapsules can be obtained according to known microencapsulation methods, preferably by using cellulose, starch or a mixture thereof for the outer shell of the microcapsules.

More preferably, the microcapsules of polymeric adhesive material have a shell made of cellulose, starch or a mixture thereof, said shell having a thickness of 10-30 μm.

In step d) of the process, hide or leather is provided, which can be smooth or suede. In the latter case, it is preferable to use microencapsulated polymeric adhesive material and relative microcapsules which have an overall diameter greater than that of the microcapsules that are used for the smooth hide or leather. This due to the different surface of the suede hide or leather, on which overly small microcapsules excessively penetrate, thus reducing its capacity to support the transfer of the sublimation ink. Therefore, in the case of suede hide or leather, it is preferred to use microcapsules of polymeric adhesive material with overall diameter greater than 60 μm.

Hide or leather can be in full form, or in the form of a cut-out, remnant, strip, band, or finished product to be printed.

Step e) of the process provides for hot pressing the side of the laminar substrate on hide or leather.

Preferably, the hot pressing step is carried out for a time period not greater than 30 seconds, at a temperature of 120° C.-230° C.

Since hide or leather is a delicate material which, when exposed to high temperatures, tends to keratinize, i.e. to harden and lose elasticity, the higher the temperature of the pressing step, the smaller the time period. For example, if a temperature greater than 200° C. is selected, then a time period not greater than 5-8 seconds is preferable. Vice versa, if a temperature lower than 150° C. is selected, then a time period is also possible that is greater than 15-20 seconds.

In particular, the side of the laminar substrate treated in step b) is hot pressed, by means of a press or a calender, directly on hide or leather for a very brief time period.

Preferably, such pressing is conducted at a temperature of 180° C.-220° C.

Preferably, said time period is 2-4 seconds.

After hot pressing step e), in step f) the laminar substrate is separated from hide or leather. The process of the invention finally comprises at least one further step selected from the two following:

a step c), to be carried out between step b) and step d), of ink jet printing with a sublimation ink on said side of the laminar substrate, a step g), to be carried out after step f), of ink jet printing with a sublimation ink on hide or leather.

The heating of the pressing step simultaneously acts on the laminar substrate and on hide or leather. During step e), the polymeric adhesive material is melted and is transferred onto the hide or leather surface to be decorated.

If step c) is selected, hide or leather at the end of step f) is already printed, due to the sublimation of the ink that is transferred onto the surface of hide or leather simultaneously with the polymeric adhesive material during step e).

If step g) is selected, hide or leather at the end of step f) is treated and ready to be printed, i.e. the ink is made to sublimate at a later time on the surface on which the polymeric adhesive material was preliminarily transferred.

In some embodiments, the process of sublimation printing on hide or leather of the invention consists essentially of the steps of:

a) providing a laminar substrate, b) applying a polymeric adhesive material comprising polyester, polyamide, polyurethane, polyethylene or a mixture thereof, on a side of said laminar substrate, d) providing hide or leather, e) hot pressing said side of the laminar substrate on said hide or leather, and f) separating the laminar substrate from hide or leather, wherein, between step b) and step d), a step c) of ink jet printing is carried out with a sublimation ink on said side of the laminar substrate, or alternatively after step f), a step g) of ink jet printing is carried out with a sublimation ink on hide or leather.

With the term "consists essentially of", it is meant that the process of the invention does not provide for additional steps, nor further materials or compounds, but that, if it did provide for these, such possible additional steps and/or further materials or compounds would not at all alter the final result on hide or leather.

In other embodiments, the process of sublimation printing on hide or leather of the invention consists of the steps of:

a) providing a laminar substrate, b) applying a polymeric adhesive material comprising polyester, polyamide, polyurethane, polyethylene or a mixture thereof, on a side of said laminar substrate, d) providing hide or leather, e) hot pressing said side of the laminar substrate on said hide or leather, and f) separating the laminar substrate from hide or leather, wherein, between step b) and step d), a step c) of ink jet printing is carried out with a sublimation ink on said side of the laminar substrate, or alternatively after step f), a step g) of ink jet printing is carried out with a sublimation ink on hide or leather.

It is intended that all the aspects identified as preferred and advantageous for the process of sublimation printing are analogously also to be deemed preferred and advantageous for all embodiments thereof.

In this regard, in another aspect, the present invention also relates to hide or leather treated to be printable by sublimation printing, as obtainable by the steps a)-b)-d)-e)-f) of the above-described process.

This means that said hide or leather treated to be printable by sublimation printing comprises a layer of polymeric adhesive material comprising polyester, polyamide, polyurethane, polyethylene or a mixture thereof, hot pressed. In this manner, it is possible to obtain a kind of intermediate semifinished product and, if desired, postpone to a later time the step g) of ink jet printing with a sublimation ink on hide or leather.

In a further aspect, the present invention relates to hide or leather printed by the process of the above-described sublimation printing.

As stated, hide or leather printed according to the invention is washable, has maintained its texture unchanged, and does not have any visible alteration with respect to the initial thickness, i.e. before the sublimation printing.

In a still further aspect, the present invention relates to a laminar substrate for sublimation printing, said substrate being in the form of sheet or strip and comprising paper, plastic material, or a combination thereof, wherein on one side of the laminar substrate a polymeric adhesive material is present comprising polyester, polyamide, polyurethane, polyethylene or a mixture thereof.

In some embodiments, said laminar substrate for sublimation printing is in the form of sheet or strip and consists essentially of paper, plastic material, or a combination thereof, at least partially covered by a layer of polymeric adhesive material comprising polyester, polyamide, polyurethane, polyethylene or a mixture thereof.

In other embodiments, said laminar substrate for sublimation printing is in the form of sheet or strip and consists of paper, plastic material, or a combination thereof, at least partially covered by a layer of polymeric adhesive material comprising polyester, polyamide, polyurethane, polyethylene or a mixture thereof.

As stated above, the polymeric adhesive material can be applied on one side of said laminar substrate by physical transport of the microencapsulated polymeric adhesive material, or electrical transport of the microencapsulated polymeric adhesive material, or by spreading of a resin containing the microencapsulated polymeric adhesive material, or by spraying a resin containing the microencapsulated polymeric adhesive material.

When a resin containing the microencapsulated polymeric adhesive material is used, this can comprise dispersants, non-ionic surfactants, Teflon waxes, or mixtures thereof.

Preferably, in said laminar substrate, said polymeric adhesive material is microencapsulated.

The laminar substrate can for example derive from a paste of paper material or from an extrusion of plastic material, in particular polyester.

In preferred embodiments, said laminar substrate is in the form of sheet or strip and includes paper, plastic material, or a combination thereof, and a layer of polymeric adhesive material comprising polyester, polyamide, polyurethane, polyethylene or a mixture thereof, said polymeric adhesive material being microencapsulated and applied by physical transport of the microencapsulated polymeric adhesive material, or electrical transport of the microencapsulated polymeric adhesive material, or by spreading of a resin containing the microencapsulated polymeric adhesive material, or by spraying a resin containing the microencapsulated polymeric adhesive material.

As stated, the laminar substrate can be in the form of sheet or strip, which can for example be unwound before the process and wound again after the printing process.

In a further aspect, the present invention relates to a kit for sublimation printing on hide or leather, said kit comprising the above-described laminar substrate, and at least one sublimation ink.

Alternatively, said kit can comprise hide or leather treated to be printable by sublimation printing, as described above, and at least one sublimation ink.

It should be understood that all the aspects identified as preferred and advantageous for the process of sublimation printing are also analogously to be deemed preferred and advantageous for the laminar substrate, for hide or leather treated to be printable, for the kits, as well as for hide or leather printed by said process of sublimation printing.

It should be understood also that deemed all the combinations of preferred aspects of the process of sublimation printing, of the laminar substrate, of hide or leather treated to be printable, of the kits, as well as hide or leather printed by said process of sublimation printing, reported above, are to be deemed as hereby disclosed.

Below are working examples of the present invention provided for illustrative purposes.

EXAMPLES

Example 1

Sublimation Printing of Leather According to the Present Invention

A remnant of white leather having surface area of approximately 50 $cm^2$ was provided along with a sheet of paper, having substantially the same surface area.

With reference to FIG. 1, a series of simplified sections is illustrated, one section for each step of the process of the invention.

On one side of the paper sheet (1), microcapsules (2) containing polyester (outer shell made of cellulose and starch) were applied by means of a spreader bar. The microcapsules had overall diameter of 60 μm and were dispersed in a cationic acrylic resin (pH 5) that facilitated the spreading on the paper sheet. The microcapsules were applied on the paper sheet in such an amount to be 16-20 $g/m^2$ (as measured once dried).

The same side of the paper sheet was then ink-jet printed with sublimation ink (3), following the desired final design.

The side of the paper sheet thus treated faced the surface of the leather (4) to be decorated and was then pressed together at a temperature of about 190° C. for 3 seconds. In this manner, the ink sublimated nearly instantaneously on the leather, decorating it (4A) as desired.

Printed sheet and leather were then separated, showing a print on the surface of the leather that was perfectly defined and with bright colors.

Figure 2:
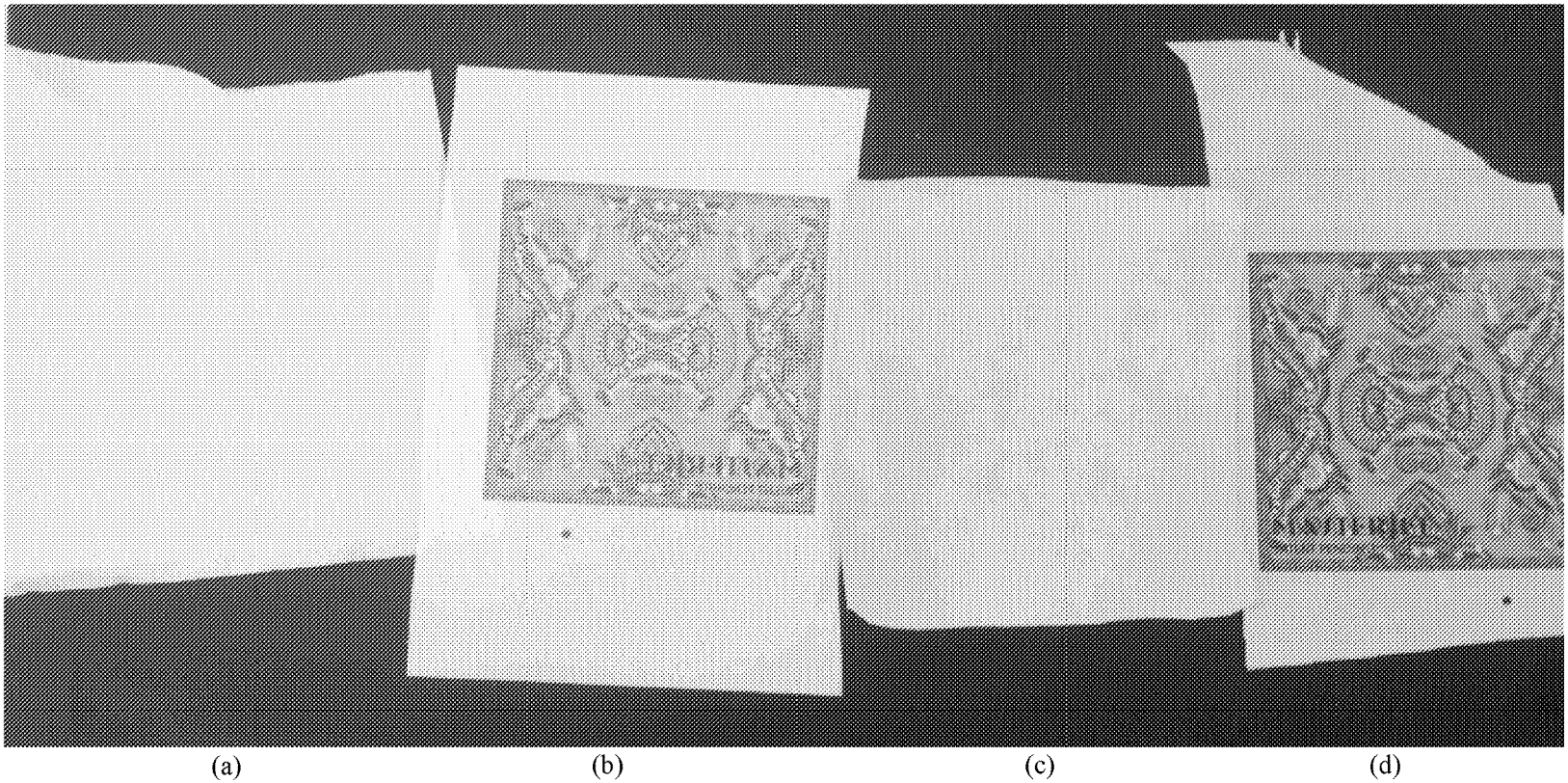
FIG. 2 shows the materials used in Example 1.

With reference to FIG. 2, the paper sheet on which the microcapsules are applied initially appeared as in FIG. 2(*a*); once ink-jet printed with sublimation ink, the paper sheet assumed the pre-selected image, as in FIG. 2(*b*), naturally a mirror image with respect to what was desired on the leather; FIG. 2(*c*) shows the remnant of starting white leather, while FIG. 2(*d*) shows the remnant of printed leather.

Example 2

Sublimation Printing of Leather According to the Present Invention

Example 1 was repeated, with the only difference that the polyester was not microencapsulated.

Comparative Example 3

Example 1 was repeated, but neither polyester, nor microencapsulated polyester were used.

Results

Figure 3:
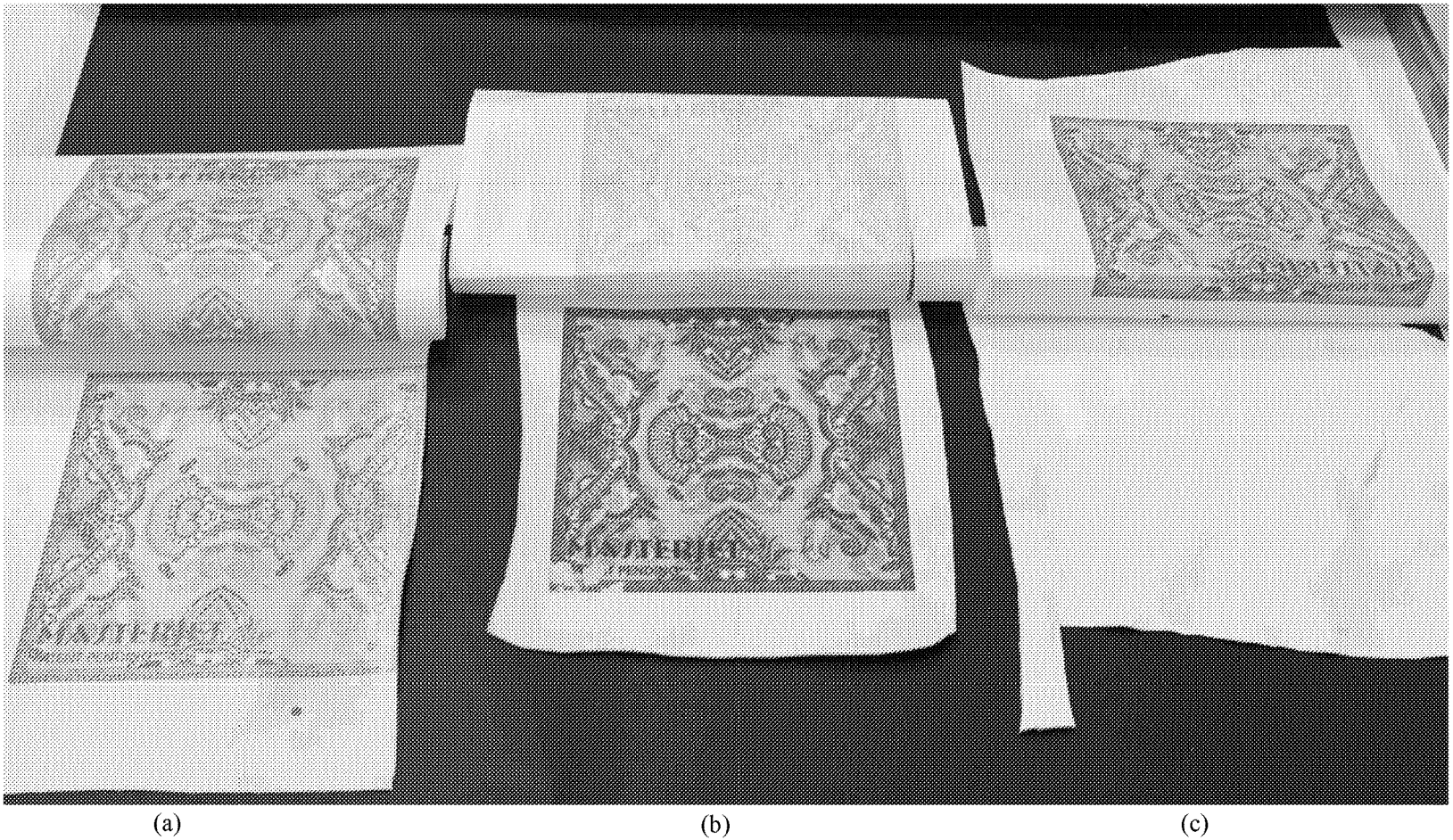
FIG. 3 shows the comparison among the printed products in Examples 1-3.

FIG. 3 compares the result of the above-reported Examples.

The printed white leather as in Example 2, i.e. according to the present invention in which polyester is employed, corresponds to FIG. 3(*a*) and offers a very well defined and integral design, even if the transfer of the ink is not complete.

The printed white leather as in Example 1, i.e. according to the present invention in which the polyester is microencapsulated, corresponds to FIG. 3(*a*) and offers a very well defined and integral design, also with significant ink transfer.

The white leather as in Example 3, i.e. without polyester, actually is not at all printed, since there was nearly no ink transfer.

Therefore, it was observed that it was possible to carry out sublimation printing on leather only at the conditions defined according to the present invention.

The invention claimed is:

1. A process of sublimation printing on hide or leather, the process comprising the steps of:

a) providing a laminar substrate, b) applying a polymeric adhesive material comprising polyester, polyamide, polyurethane, polyethylene, or a mixture thereof, on a side of said laminar substrate, d) providing hide or leather, e) hot pressing said side of the laminar substrate on said hide or leather, and f) separating the laminar substrate from hide or leather, wherein, between step b) and step d), a step c) of ink jet printing is carried out with a sublimation ink on said side of the laminar substrate, or alternatively after step f), a step g) of ink jet printing is carried out with a sublimation ink on hide or leather, and wherein said polymeric adhesive material is microencapsulated.

2. The process of claim 1, wherein said laminar substrate is in the form of sheet or strip, and includes paper, plastic material, or a combination thereof.

3. The process of claim 1, wherein the step e) is carried out for a time period not higher than 30 seconds, at a temperature of 120° C.–230° C.

4. The process of claim 1, wherein, at the end of step b), the polymeric adhesive material on the side of the laminar substrate is in an amount of 10-50 g/m$^2$, as measured once dried.

5. The process of claim 1, wherein said polymeric adhesive material is microencapsulated in microcapsules, each having an overall diameter of 40-100 microns.

6. The process of claim 1, wherein the step b) of application of said polymeric adhesive material on one side of said laminar substrate is performed by electrical transport of the microencapsulated polymeric adhesive material, or by spreading of a resin containing the microencapsulated polymeric adhesive material, or by spraying a resin containing the microencapsulated polymeric adhesive material.

7. The process of claim 1, wherein said polymeric adhesive material is microencapsulated in microcapsules having a shell of cellulose, starch or mixture thereof, said shell having a thickness of 10-30 microns.

8. Hide or leather printed by the process of sublimation printing of claim 1.

9. Laminar substrate for sublimation printing, said substrate being in the form of sheet or strip and comprising paper, plastic material, or a combination thereof, wherein on one side of the laminar substrate, is present a polymeric adhesive material comprising polyester, polyamide, polyurethane, polyethylene or a mixture thereof, wherein said polymeric adhesive material is microencapsulated.

10. Hide or leather treated to be printable by sublimation printing, obtainable by the steps a)-b)-d)-e)-f) of the process of claim 1.

11. Kit for the sublimation printing of hide or leather, said kit comprising the laminar substrate of claim 9, and at least one sublimation ink.

12. Kit for sublimation printing on hide or leather, said kit including the treated hide or leather of claim 10, and at least one sublimation ink.

* * * * *